United States Patent [19]

Hambleton

[11] Patent Number: 4,771,938

[45] Date of Patent: Sep. 20, 1988

[54] CARTON WITH RECLOSABLE MEMBRANE LINER

[75] Inventor: Thomas P. Hambleton, Thompson Ridge, N.Y.

[73] Assignee: International Paper Company, Purchase, N.Y.

[21] Appl. No.: 883,882

[22] Filed: Jul. 9, 1986

[51] Int. Cl.[4] ..... B65D 5/06

[52] U.S. Cl. ..... 229/123.1; 229/125.34; 229/133

[58] Field of Search ..... 229/123.1, 123.2, 123.3, 229/125.08, 125.34, 133; 220/258; 215/232

[56] References Cited

U.S. PATENT DOCUMENTS

| | | | |
|---|---|---|---|
| 1,279,589 | 1/1918 | Robson | 229/125.34 |
| 2,795,364 | 3/1957 | Benzon-Petersen | 229/37 |
| 2,847,151 | 8/1958 | Meyer-Jagenberg | 229/125.08 |
| 2,886,231 | 1/1959 | Benzon-Petersen | 229/14 |
| 3,049,224 | 7/1962 | Fredette et al. | 206/42 |
| 3,078,986 | 12/1963 | Ushkow | 206/56 |
| 3,190,531 | 11/1965 | Holmstrom | 229/7 |
| 3,272,422 | 2/1966 | Miller | 229/43 |
| 3,288,345 | 3/1966 | Dilot | 229/14 |
| 3,362,608 | 6/1968 | Dilot | 229/14 |
| 3,580,483 | 7/1971 | Young | 229/51 |
| 3,656,682 | 12/1972 | Giuliani | 229/37 R |
| 3,741,463 | 1/1973 | Young et al. | 229/17 R |
| 3,746,243 | 7/1973 | Young | 229/125.34 |
| 3,756,500 | 2/1973 | Young et al. | 229/37 R |
| 3,767,076 | 10/1973 | Kennedy | 215/232 |
| 3,893,566 | 7/1975 | Ross | 229/125.08 |
| 3,973,719 | 8/1976 | Johnson et al. | 220/258 |
| 4,583,679 | 4/1986 | Johnson | 229/123.3 |

FOREIGN PATENT DOCUMENTS

| | | | |
|---|---|---|---|
| 1690 | 5/1979 | European Pat. Off. | 220/258 |

*Primary Examiner*—Stephen Marcus
*Assistant Examiner*—Gary E. Elkins
*Attorney, Agent, or Firm*—Walt Thomas Zielinski

[57] ABSTRACT

An open ended carton which includes a moisture barrier membrane liner attached to interior surfaces of a cover. The membrane liner includes first and second hingedly connected attachment sections which are heat sealed to the cover at marginal sealing areas. A pour spout is provided by pivoting one attachment section outwardly from the carton opening. Pressure sensitive adhesive disposed on the marginal areas of the outwardly pivoting attachment section effects a moisture barrier closure of the carton.

19 Claims, 4 Drawing Sheets

10
12
14
20
24
28
30
32
34
36
40
42
44
46
50
52
54
56
60
62
2
3

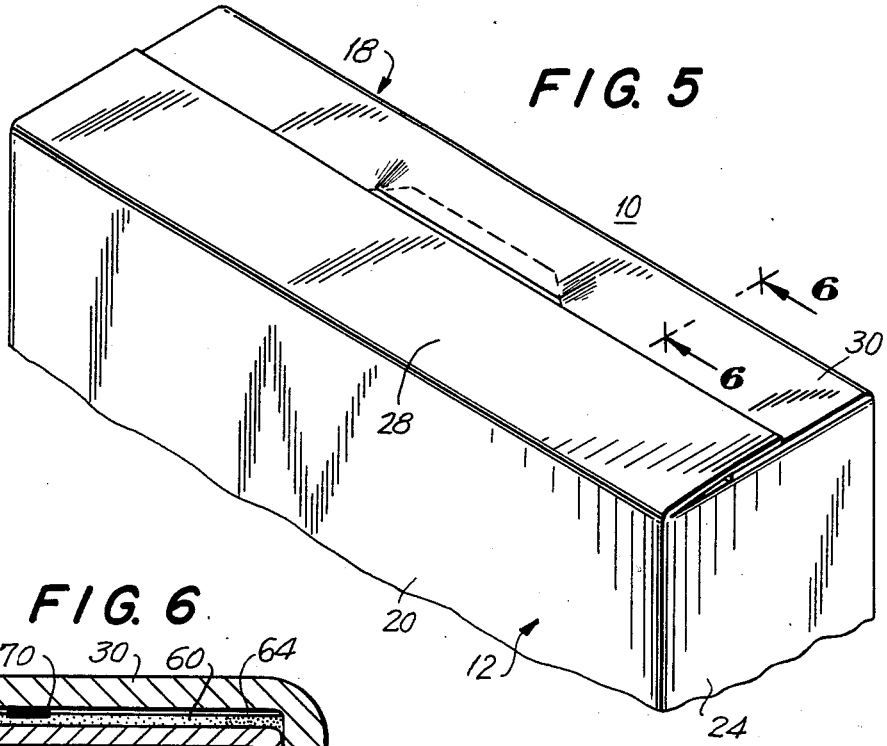
FIG. 5
FIG. 6
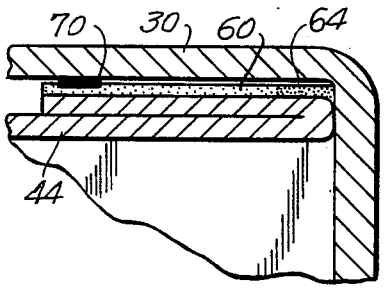
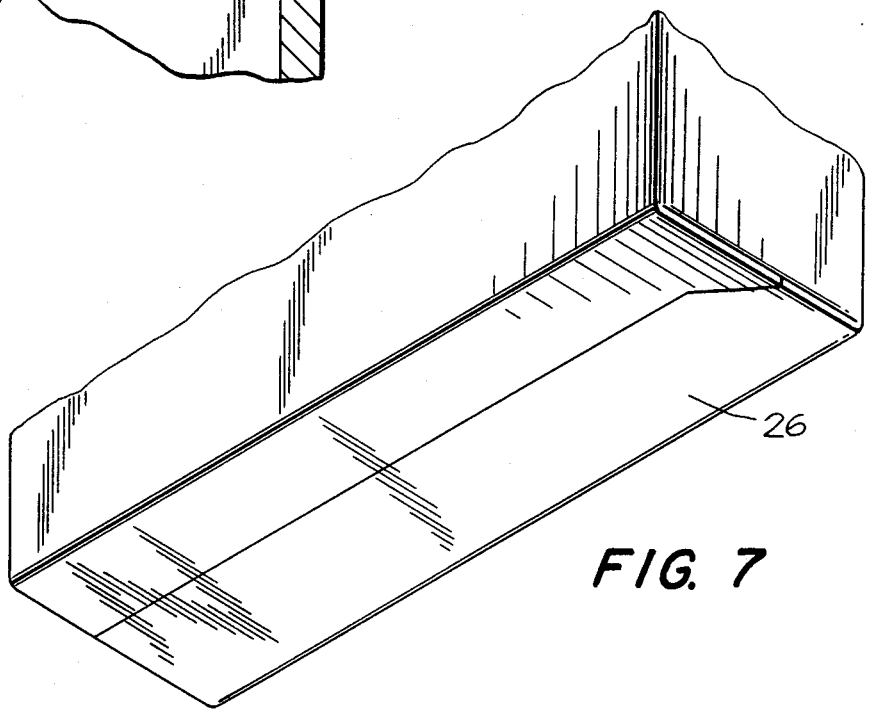
FIG. 7

CARTON WITH RECLOSABLE MEMBRANE LINER

DESCRIPTION

1. Field of Invention

This invention generally relates to moisture barrier carton constructions and, more particularly, a carton including a pressure sensitive membrane which provides a reclosable pour spout.

2. Background Art

In packaging granulated or pulverized food products and products having sifting characteristics, it has been customary in the food industry to employ cartons provided with pouch liners formed from moisture impervious papers, foils or plastics. Such pouch liners typically have ends which are fused by heat to form closure ridges or fins. Once opened, the carton is resealed by folding or rolling the open ends of the inner pouch.

In order to effect cost savings in material and production machinery, and extended product shelf life, the packaging industry has developed and marketed linerless cartons provided with thermoplastic moisture-proof coatings and moisture barrier closures. This approach is exemplified by U.S. Pat. Nos. 2,795,364 and 2,886,231, both to B. Benzon-Patersen, which are directed to cartons having rectangular parallelepiped configurations and a closure formed by hingedly attached and overlapping closure flaps. A barrier seal is obtained by attaching a sealing membrane to the flaps when they are oriented in an outward direction prior to their closure. However, this structure does not provide an effective barrier seal once the membrane is broken limiting the usefulness of the package.

An alternative carton arrangement is disclosed in U.S. Pat. No. 3,190,531 to Holmstrom, which shows a membrane sealing sheet attached to interior surfaces of carton closure flaps. In order to provide a resealing feature, the membrane is attached to one flap at areas which outline an inwardly oriented U-shaped arch, and a sidewall panel adjoining the flap is provided with crease lines which form a spout. The spout is provided by severing the sealed bottom end of the U-shaped arch to define an opening to the interior of the carton, see FIGS. 1–3. The container is resealed by folding the flap across the opening in the container and interlocking the closure flaps.

In another approach of the prior art, represented by U.S. Pat. No. 3,272,422 to Miller, a reclosable package feature is provided by applying a pressure sensitive adhesive with an overlying peelable film to a closure lid. The peelable film is heat sealed to a package opening to seal the package. Once opened, the lid is resealed by pressing the adhesive against the peelable film. This closure is not suitable for packaging granulated food products in that it does not provide a pour spout structure for effective dispensing of foodstuff.

The present invention is directed to an improved linerless carton having a sealing membrane and resealing structure of uncomplex design and enhanced effectiveness over prior art pouch and adhesive closures. The invention advances known pressure sensitive adhesive closures by incorporating a pour spout structure. It will be appreciated that linerless cartons provide cost savings in materials and manufacturing efficiencies over pouch arrangements, and that a reclosable moisture barrier carton with an effective dispensing spout will meet a need of the packaging art.

Accordingly, it is the broad object of the present invention to provide an improved moisture barrier carton of economical design which is resealable.

A more specific object of the invention is to provide a linerless carton incorporating a closure membrane which obtains a moisture barrier seal improved over the prior art.

A still further object of the invention is to provide a moisture barrier closure which includes a pour spout for dispensing foodstuff.

3. Disclosure of the Invention

In the present invention, these purposes, as well as others which will be apparent, are achieved generally by providing an open ended carbon including a moisture barrier membrane liner which seals to the carton opening. The carton includes an upright boundary wall having a top end peripheral edge which defines the carton opening, and a cover which is attached to the top end peripheral edge for closing the carton. The membrane liner includes first and second attachment sections which are hingedly connected at a transverse score line, inner surfaces, and marginal sealing areas located on the inner surfaces for attaching the membrane to the interior surface of the cover. Outward movement of one of the attachment sections about the transverse line provides a pour spout. A resealing means which includes a pressure sensitive adhesive is disposed on the outward pivoting attachment section for closure of the carton after the liner seal is broken.

In a preferred embodiment of the invention, the carton has a generally parallelepiped configuration including front, rear, and side wall sections, and the cover includes front, rear, and side closure flaps which are hingedly attached at embossed score lines to the peripheral edge of the carton. The membrane liner preferably has a generally rectangular configuration including longitudinal and transverse peripheral edges, and longitudinal and transverse score lines which are spaced inwardly from the peripheral edges and disposed in overlying relation with respect to the embossed carton score lines. This arrangement facilitates attachment of the liner to the carton and closure of the cover. In this preferred embodiment the carton includes a milk carton style bottom end closure.

Other objects, features and advantages of the present invention will be apparent when the detailed description of the preferred embodiments of the invention are considered in conjunction with the drawings which should be construed in an illustrative and not limiting sense as follows:

BRIEF DESCRIPTION OF THE DRAWINGS

FIG. 5 shows the closure flaps secured together to provide a carton cover;

FIG. 6 is a horizontal view taken along the line 6—6 of FIG. 5;

FIG. 7 shows a perspective view of a bottom end milk style closure employed in the carton.

BEST MODE OF CARRYING OUT THE INVENTION

Figures 1, 2:
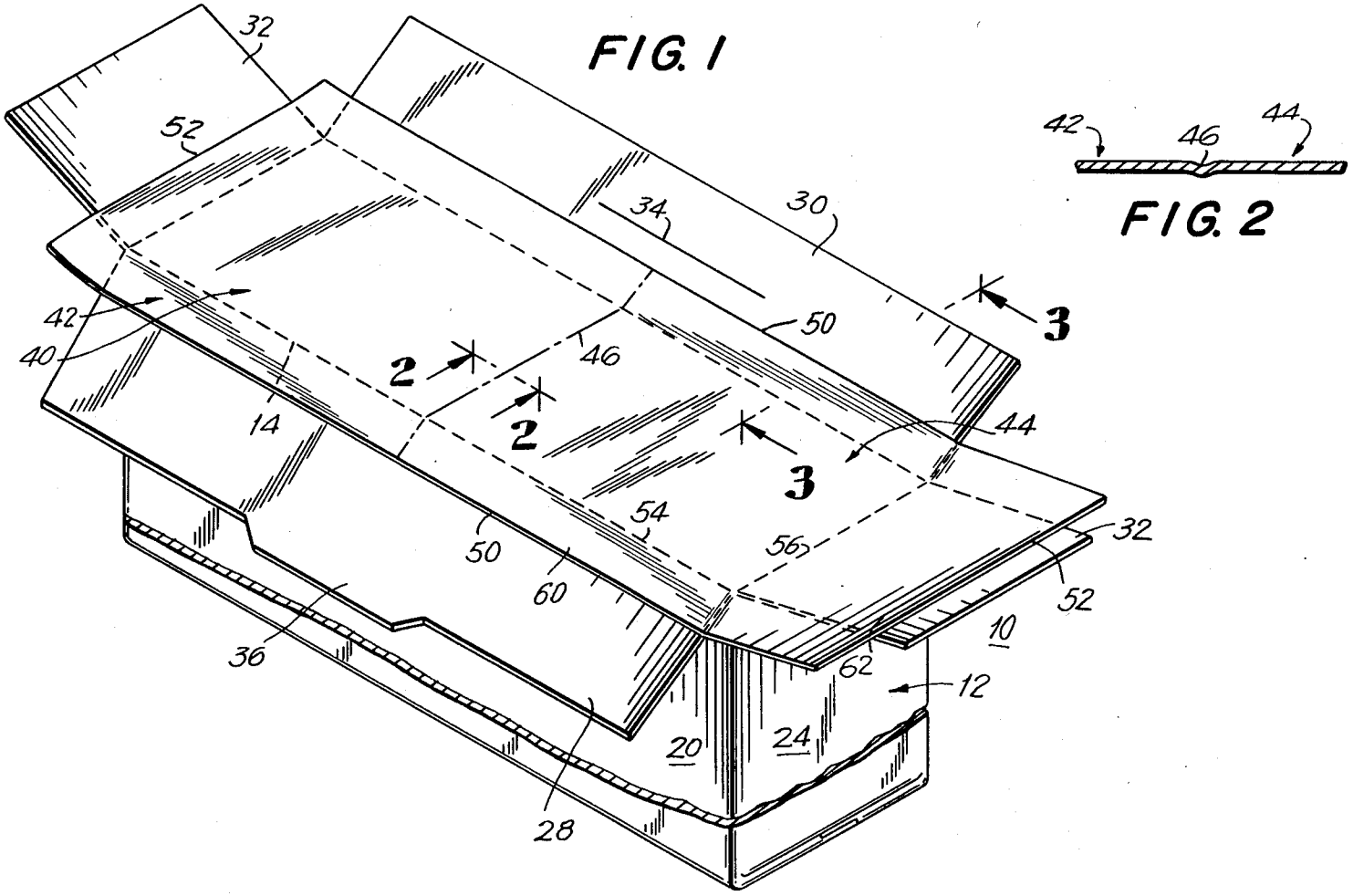
FIG. 1 is a perspective view of a rectangular parallelepiped carton according to the invention showing an arrangement of closure flaps and a membrane liner.
FIG. 2 is a horizontal cross-sectional view of the membrane liner taken along the line 2—2 of FIG. 1.

Referring now to the drawings, a carton, generally designated 10, including a reclosable moisture barrier membrane liner 40 is shown in FIGS. 1-7. The carton 10 is formed from a blank, illustrated in FIG. 8, which will be described following a discussion of the carton construction.

The carton 10 which is preferably fabricated of a conventional polyethene extrusion coated folding carton paperboard, includes a body portion formed by an upright boundary wall 12, a top end peripheral edge 14 which defines a carton opening 16, and a cover 18 for closing the top end of the carton. In the preferred embodiment, the boundary wall has a generally parallelepiped configuration including front 20, rear 22, side 24, and bottom 26 wall sections, and the cover 18 includes front 28, rear 30 and side 32 closure flaps which are hingedly attached to the peripheral edge 14 of the carton at embossed score lines 15.

According to the invention, a moisture barrier closure of the carton is obtained by employment of a membrane liner 40 which may be fabricated of a moisture barrier coated paper, plastic or foil having specifications conventionally known in the art. The membrane liner 40 which preferably has a rectangular configuration includes first and second attachment sections 42, 44 which are hingedly connected at a transverse score line 46, inner surfaces 48, longitudinal and transverse peripheral edges 50, 52, and longitudinal and transverse score lines 54, 56 which are spaced inwardly from the peripheral edges. The longitudinal and transverse score lines 54, 56 of the liner are disposed in overlying relation with respect to the embossed score lines 15 of the carton which form closure flaps 28-32, see FIGS. 1 and 4.

Figure 3:
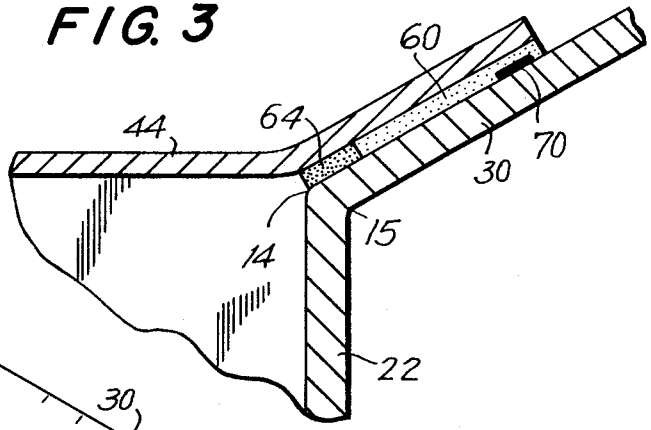
FIG. 3 is a horizontal cross-sectional view of the carton taken along the line 3—3 of FIG. 1.

Longitudinal and transverse marginal areas 60, 62 in the membrane liner 40 bounded by the longitudinal and transverse peripheral edges and score lines 50-56 are secured to interior surfaces of the closure flaps 28, 30, 32 by conventional heat sealing processes, as shown in FIG. 3. The overlying orientation of the liner 40 and carton boundary wall score lines 15 facilitate alignment of the membrane liner for heat seal attachment to the cover flaps, and closure of the cover 18, see FIGS. 5 and 6.

Figure 4:
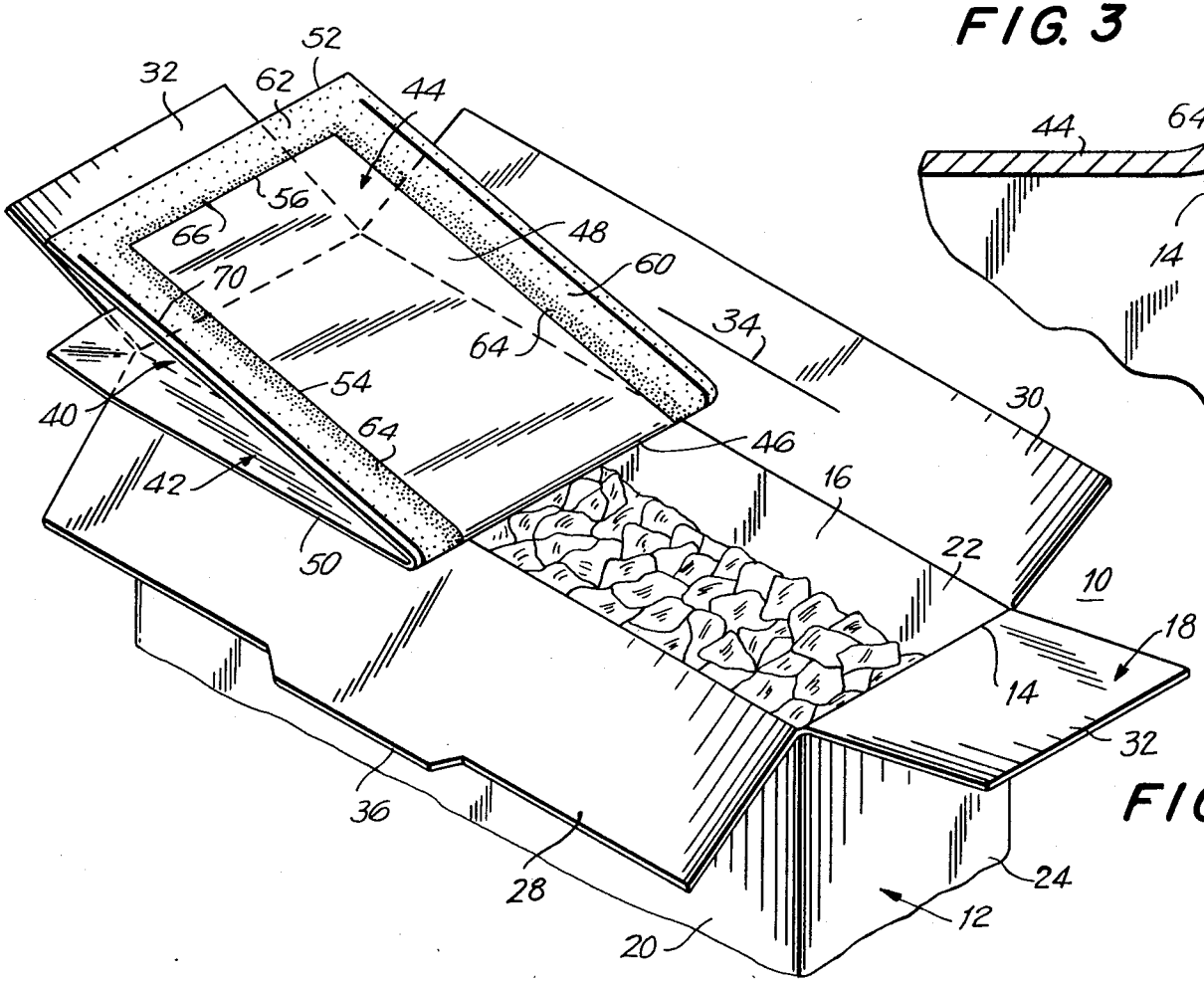
FIG. 4 shows the manner in which the membrane liner is folded outwardly to provide a dispensing spout.

A moisture barrier reclosure of the membrane liner 40 is provided by a resealing means including a pressure sensitive adhesive 70 which is disposed on the marginal areas 60, 62 of the membrane liner. In the preferred embodiment, the membrane liner is permanently heat sealed to the carton flaps 28-32, and a pressure sensitive adhesive 70 is applied to longitudinal marginal areas 60 of the second longitudinal attachment section 44. This arrangement maintains the liner 40 in aligned relation with the carton opening 16, as shown in FIG. 3, and facilitates pivotal movement of the second attachment section 44 about transverse score line 46 to provide a pour spout. As best shown in FIG. 4, the second attachment section 44 is readily pivoted about the transverse line 46 to overlie the first attachment section 42 for effective dispensing of product from the carton.

A preferred membrane liner 40 is fabricated of a 40 lb. per 3000 sq. ft. machine finished bleached kraft paper which is coated on its inner surfaces 48 with a substrate of aqueous polyvinyldine chloride (PVDC), and an outer laminated or extrusion coating of polyethylene film. Marginal areas 60, 62 in the second attachment section 44 can be pattern coated with a variety of polymer based dispersions, such as ethylene vinyl acetate (EVA) or ethylene acrylic acid (EAA) to facilitate severance of the heat seal between the membrane and carton. In the preferred embodiment, the marginal areas 60, 62 include inner portions 64, 66 adjacent the top end peripheral edge 14 which are free of the polymer dispersion to assure a barrier seal, see FIG. 3.

The pressure sensitive adhesive 70 is applied to the longitudinal marginal areas 60 to provide the moisture barrier resealing means of the invention. A suitable pressure sensitive adhesive is marketed by Malcolm Nicol Co., Lyndhurst, N.J., under the product designation "Nicolmelt P1742."

It will be recognized that employment of the pressure sensitive adhesive 70 of the invention is a departure from prior art liners which failed to provide a moisture barrier resealing feature, see e.g., U.S. Pat. No. 2,886,231 to Benzon-Peterson.

FIGS. 5 and 6 illustrate the manner in which the closure flaps 28, 30, 32 are folded inwardly with the attached membrane liner 40 to form a cover 18 for the carton. The closure flaps may be adhesively attached for shipping and product display and provided with a conventional slot and tab 34, 36 arrangement for fastening the closure flaps together.

Turning to FIG. 7, it will be seen that the carton includes a conventional milk carton style bottom end closure. Such conventional closures are shown in U.S. Pat. Nos. 3,120,335 and 3,120,333. The membrane liner and milk carton closure advantageously coact to provide a moisture barrier carton without requirement of conventional pouch arrangements effecting cost savings.

Figure 8:
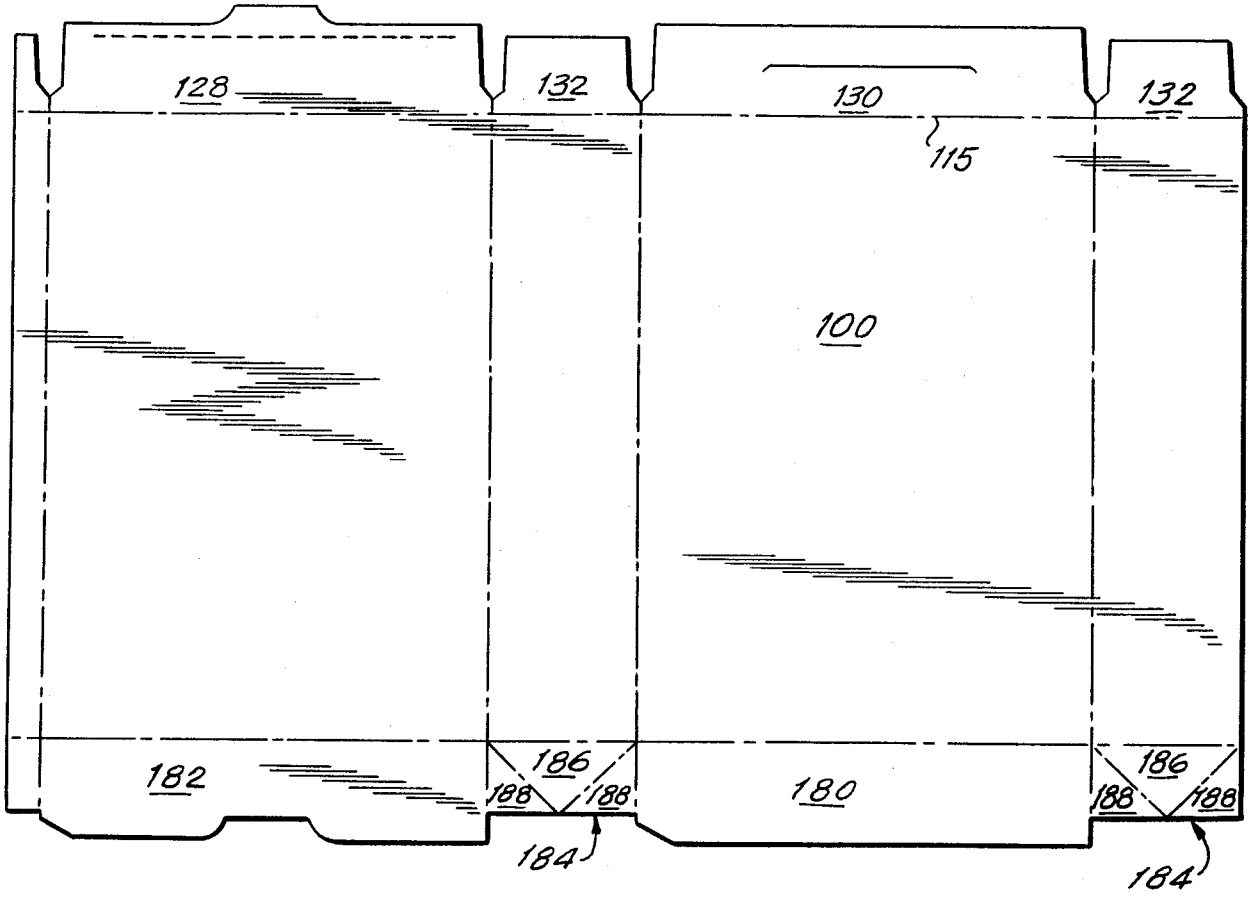
FIG. 8 is a plan view of a carton blank for forming the carton of FIGS. 1-7.

A carton blank for forming the linerless carton of the invention, generally designated 100, is illustrated in FIG. 8. Attention is directed to the arrangement of front, rear and side closure flap panels 128-132 which are hingedly attached to the carton body at a top end peripheral edge 114. The traditional milk carton bottom closure is formed by overlapping longitudinal base panels 180, 182, and inwardly folding side panels 184 which include sections 186, 188.

From the foregoing, it will be appreciated that the present invention provides a moisture barrier reclosable carton 10 which achieves the objects stated heretofore. In particular, a carton 10 is provided which includes a membrane liner 40 which obtains a reclosable moisture barrier seal. The membrane liner 40 includes hingedly connected attachment sections 42, 44 which coact with the carton closure flaps 28-32 to provide a pour spout. A pressure sensitive adhesive 70 attached to the membrane assures a high integrity reclosure of the carton.

Numerous modifications are possible in light of the above disclosure. For example, the drawings show a carton having a generally parallelepiped configuration. It will be appreciated that other carton configurations are within the scope of the disclosure. Similarly, in the preferred embodiment the pressure sensitive adhesive 70 is applied to longitudinal marginal areas 60 in the second attachment section 44, the adhesive may also be applied to the first attachment section 42.

Therefore, although the invention has been described with reference to certain preferred embodiments, it will be appreciated that other carton constructions may be devised, which are nevertheless within the scope and spirit of the invention as defined by the claims appended hereto.

I claim:

1. A carton which comprises: a body portion formed by an upright boundary wall, and a top end peripheral edge which defines a carton opening; a cover which is hingedly attached to the peripheral edge for closing the top end of the carton, said cover including an interior surface; a membrane liner for sealing the carton, said liner including first and second attachment sections which are hingedly connected by a transverse score line, an inner surface, and marginal sealing areas located on said inner surface; attachment means for attaching said marginal sealing areas to said interior surface to effect a barrier seal of said first and second attachment sections to the carton; and resealing means different from said attachment means for resealing said carton after said barrier seal is severed to provide a reclosable pour spout hinged at said transverse score line, said resealing means including a pressure sensitive adhesive disposed on a portion of said marginal sealing areas.

2. A carton according to claim 1, wherein said attachment means includes an outer covering of heat sealable material disposed on said inner liner surface.

3. A carton according to claim 1, wherein said attachment means includes an outer covering of heat sealable material disposed on said inner liner surface, said marginal sealing areas extend around the entire periphery of said liner, and said pressure sensitive adhesive is located on the marginal sealing areas in said second attachment section and disposed over a portion of said heat sealable material.

4. A carton according to claim 3, wherein said resealing means effects a moisture barrier reclosure of said membrane liner.

5. A carton which comprises: a body portion formed by an upright boundary wall, and a top end peripheral edge which defines a carton opening; a cover which is hingedly attached to the peripheral edge for closing the top end of the carton, said cover including an interior surface; a membrane liner fabricated of a 40 lb. per 3000 sq. ft. machine finished bleached kraft paper for sealing the carton, said liner including first and second attachment sections which are hingedly connected by a transverse score line, an inner surface, and marginal sealing areas located on said inner surface which extend around the entire periphery of said liner, said inner surface having a substrate coating of aqueous PVDC, and an outer covering of polyethylene film, said membrane liner being attached to said interior surface at said marginal sealing areas by a heat sealing process to effect a barrier seal of said first and second attachment sections to the carton; and resealing means for resealing said carton after said seal is severed to provide a reclosable pour spout hinged at said transverse score line, said resealing means including a pressure sensitive adhesive disposed over a portion of said polyethylene film in said marginal sealing areas.

6. A carton according to claim 5, wherein the polyethylene film in said marginal sealing areas of said second attachment section include portions which are coated with a polymer based dispersion.

7. A carton according to claim 6, wherein the polymer based dispersion is ethylene vinyl acetate.

8. A carton according to claim 6, wherein the polymer based dispersion is ethylene acrylic acid.

9. A carton according to claim 6, wherein the body portion has a generally parallelepiped configuration and the boundary wall includes front, rear and side wall sections, the cover includes front, rear and side closure flaps formed in the top end of the boundary wall by embossed score lines, and the membrane liner is attached to the closure flaps.

10. A carton according to claim 9, wherein the membrane liner has a generally rectangular configuration including longitudinal and transverse peripheral edges, and longitudinal and transverse score lines are, respectively, spaced inwardly from said longitudinal and transverse peripheral edges, said longitudinal and transverse score lines being disposed in overlying relation with respect to the embossed carton score lines.

11. A carton according to claim 10, wherein the carton includes a moisture barrier bottom end closure.

12. A carton having a parallelepiped configuration which comprises: a body portion including front, rear and side wall sections, and a top end peripheral edge which defines a carton opening; a cover for closing the top end of the carton which includes front, rear and side closure flaps formed by embossed score lines in the body portion, said cover including an interior surface; a membrane liner for sealing the carton, said liner having a generally rectangular configuration including longitudinal and transverse peripheral edges, first and second attachment sections which are hingedly connected by a transverse score line, an inner surface, and longitudinal and transverse marginal sealing areas located on said inner surface, said liner also including longitudinal and transverse score lines which are respectively spaced inwardly from said longitudinal and transverse peripheral edges, said longitudinal and transverse score lines being disposed in overlying relation with respect to the embossed score lines of the carton; attachment means for attaching said marginal sealing areas to said interior surface to effect a barrier seal of said first and second attachment sections to the cover; and resealing means for resealing said carton after said barrier seal is severed to provide a reclosable spout hinged at said transverse score line.

13. A carton according to claim 12, wherein said longitudinal and transverse marginal sealing areas are located in the area bounded by said longitudinal and transverse peripheral edges and said longitudinal and transverse score lines of the liner, said attachment means includes an outer covering of heat sealable material disposed on said inner liner surface, and the attachment of said liner to the carton is effected by a heat sealing process.

14. A carton according to claim 13, wherein said means for resealing said carton includes a pressure sensitive adhesive disposed on said marginal sealing areas in at least one of said first and second attachment sections.

15. A carton according to claim 14, wherein said membrane liner is a 40 lb. per 3000 sq. ft. machine finished bleached kraft paper, said inner liner surface has a substrate coating of aqueous PVDC, an outer covering of polyethylene film, and said pressure sensitive adhesive is disposed over a portion of said polyethylene film.

16. A carton according to claim 15, wherein said polyethylene film is coated with a polymer based dispersion on portions of said marginal sealing areas in at least one of said first and second attachment sections.

17. A carton according to claim 16, wherein said polymer based dispersion is ethylene vinyl acetate.

18. A carton according to claim 16, wherein said polymer based dispersion is ethylene acrylic acid.

19. A carton according to claim 15, wherein the carton includes a moisture barrier bottom end closure.

* * * * *